US008866401B2

(12) United States Patent
Shearer et al.

(10) Patent No.: US 8,866,401 B2
(45) Date of Patent: Oct. 21, 2014

(54) MULTI-STAGE POWER SUPPLY FOR A LOAD CONTROL DEVICE HAVING A LOW-POWER MODE

(75) Inventors: Thomas M. Shearer, Macungie, PA (US); Mehmet Ozbek, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 1150 days.

(21) Appl. No.: 12/708,754

(22) Filed: Feb. 19, 2010

(65) Prior Publication Data

US 2010/0225240 A1 Sep. 9, 2010

Related U.S. Application Data

(60) Provisional application No. 61/158,165, filed on Mar. 6, 2009.

(51) Int. Cl.
*H05B 41/36* (2006.01)
*H05B 37/02* (2006.01)

(52) U.S. Cl.
CPC ..... *H05B 37/0263* (2013.01)
USPC ..... 315/247; 315/291; 315/246; 323/273

(58) Field of Classification Search
USPC ..... 315/246, 247, 291, 294, 297, 312
See application file for complete search history.

(56) References Cited

U.S. PATENT DOCUMENTS 4,717,863 A 1/1988 Zeiler
5,627,434 A 5/1997 Sekiya et al.
6,441,590 B1 8/2002 Amantea et al.
6,674,248 B2 1/2004 Newman, Jr. et al.
6,707,261 B2 3/2004 Ito et al.

(Continued)

FOREIGN PATENT DOCUMENTS

CN 1524333 A 8/2004
CN 1606767 A 4/2005

(Continued)

OTHER PUBLICATIONS

European Patent Office, European Search Report for European Patent Application No. 12163764.9, May 15, 2012, 6 pages.

(Continued)

*Primary Examiner* — Douglas W Owens
*Assistant Examiner* — Jonathan Cooper
(74) *Attorney, Agent, or Firm* — Condo Roccia Koptiw LLP

(57) ABSTRACT

A multi-stage power supply for a load control device is able to operate in a low-power mode in which the power supply has a decreased power consumption when an electrical load controlled by the load control device is off. The load control device comprises a load control circuit and a controller, which operate to control the amount of power delivered to the load. The power supply comprises a first efficient power supply (e.g., a switching power supply) operable to generate a first DC supply voltage. The power supply further comprises a second inefficient power supply (e.g., a linear power supply) operable to receive the first DC supply voltage and to generate a second DC supply voltage for powering the controller. The controller controls the multi-stage power supply to the low-power mode when the electrical load is off, such that the magnitude of the first DC supply voltage decreases to a decreased magnitude and the inefficient power supply continues to generate the second DC supply voltage.

23 Claims, 6 Drawing Sheets

(56) References Cited

U.S. PATENT DOCUMENTS

| | | | | |
|---|---|---|---|---|
| 6,720,739 | B2 | 4/2004 | Konopka | |
| 6,731,078 | B2 | 5/2004 | Huber et al. | |
| 6,762,570 | B1 * | 7/2004 | Fosler | 315/312 |
| 6,969,959 | B2 * | 11/2005 | Black et al. | 315/307 |
| 7,061,189 | B2 | 6/2006 | Newman, Jr. et al. | |
| 7,075,254 | B2 | 7/2006 | Chitta et al. | |
| 7,091,672 | B2 | 8/2006 | Steffie et al. | |
| 7,282,865 | B2 | 10/2007 | Van Casteren | |
| 7,285,919 | B2 | 10/2007 | Newman, Jr. et al. | |
| 7,312,582 | B2 | 12/2007 | Newman, Jr. et al. | |
| 7,369,060 | B2 | 5/2008 | Veskovic et al. | |
| 7,432,661 | B2 * | 10/2008 | Taipale et al. | 315/209 R |
| 7,446,486 | B2 | 11/2008 | Steffie et al. | |
| 7,528,554 | B2 | 5/2009 | Chitta et al. | |
| 2002/0109466 | A1 | 8/2002 | Huber et al. | |
| 2006/0017409 | A1 * | 1/2006 | Hsieh | 315/360 |
| 2006/0125426 | A1 | 6/2006 | Veskovic et al. | |
| 2006/0244392 | A1 | 11/2006 | Taipale et al. | |
| 2008/0088180 | A1 | 4/2008 | Cash et al. | |
| 2008/0180037 | A1 | 7/2008 | Srimuang | |
| 2008/0246415 | A1 | 10/2008 | Chitta et al. | |
| 2008/0258551 | A1 | 10/2008 | Chitta et al. | |
| 2008/0278086 | A1 * | 11/2008 | Chitta et al. | 315/224 |
| 2008/0315779 | A1 | 12/2008 | Taipale et al. | |
| 2009/0160409 | A1 | 6/2009 | Carmen | |
| 2009/0244944 | A1 * | 10/2009 | Jang et al. | 363/126 |
| 2009/0273958 | A1 * | 11/2009 | Baby | 363/127 |
| 2009/0315400 | A1 | 12/2009 | Howe et al. | |

FOREIGN PATENT DOCUMENTS

| | | |
|---|---|---|
| CN | 101099417 A | 1/2008 |
| DE | 602 07 396 T2 | 8/2006 |
| EP | 1 231 821 Al | 8/2002 |
| EP | 1374366 B1 | 11/2005 |
| WO | WO 02/082618 | 10/2002 |

OTHER PUBLICATIONS

European Patent Office, International Search Report and Written Opinion for International Patent Application No. PCT/US2010/025894, May 20, 2010, 11 pages.

* cited by examiner

MULTI-STAGE POWER SUPPLY FOR A LOAD CONTROL DEVICE HAVING A LOW-POWER MODE

CROSS-REFERENCE TO RELATED APPLICATIONS

This application is a non-provisional application of commonly-assigned U.S. Provisional Application Ser. No. 61/158,165, filed Mar. 6, 2009, entitled MULTI-STAGE POWER SUPPLY FOR A LOAD CONTROL DEVICE HAVING A LOW-POWER MODE, the entire disclosure of which is hereby incorporated by reference.

BACKGROUND OF THE INVENTION

1. Field of the Invention

The present invention relates to a power supply for a load control device, specifically, a multi-stage power supply for an electronic dimming ballast or light-emitting diode driver, where the power supply is able to operate in a low-power mode in which the power supply has a decreased power consumption.

2. Description of the Related Art

Typical load control devices are operable to control the amount of power delivered to an electrical load, such as a lighting load or a motor load, from an alternating-current (AC) power source. One example of a typical load control device is a standard dimmer switch, which comprises a bidirectional semiconductor switch, such as a triac, coupled in series between the power source and the load. The semiconductor switch is controlled to be conductive and non-conductive for portions of a half-cycle of the AC power source to thus control the amount of power delivered to the load. A "smart" dimmer switch comprises a microprocessor (or similar controller) for controlling the semiconductor switch and a power supply for powering the microprocessor. In addition, the dimmer switch may comprise, for example, a memory, a communication circuit, and a plurality of light-emitting diodes (LEDs) that are all powered by the power supply.

Another example of a typical load control device is an electronic dimming ballast, which is operable to control the intensity of a gas discharge lamp, such as a fluorescent lamp. Electronic dimming ballasts typically comprise an inverter circuit having one or more semiconductor switches, such as field-effect transistors (FETs) that are controllably rendered conductive to control the intensity of the lamp. The semiconductor switches of the inverter circuit are often controlled by integrated circuit or a microprocessor. Thus, a typical electronic dimming ballast also comprises a power supply for powering the integrated circuit or microprocessor.

By decreasing the amount of power delivered to an electrical load, a load control device is operable to reduce the amount of power consumed by the load and thus save energy. However, the internal circuitry of the load control device (e.g., the microprocessor and other low-voltage circuitry) also consumes power, and may even consume energy when the electrical load is off (i.e., the load control device operates as a "vampire" load). Thus, it is desirable to reduce the amount of power consumed by a load control device, and particularly, the amount of standby power consumed by the load control device when the electrical load is not powered.

SUMMARY OF THE INVENTION

According to an embodiment of the present invention, a load control device for controlling the amount of power delivered from a power source to an electrical load comprises a load control circuit, a controller, and a multi-stage power supply that can operate in a low-power mode in which the power supply has a decreased power consumption. The load control circuit is adapted to be coupled between the source and the load for controlling the power delivered to the load. The controller is operatively coupled to the load control circuit and is operable to control the load control circuit to turn the electrical load off. The multi-stage power supply comprises a first efficient power supply operable to generate a first DC supply voltage having a normal magnitude in a normal mode of operation, and a second inefficient power supply operable to receive the first DC supply voltage and to generate a second DC supply voltage for powering the controller. The controller is coupled to the multi-stage power supply for controlling the multi-stage power supply to the low-power mode when the electrical load is off, such that the magnitude of the first DC supply voltage decreases to a decreased magnitude that is less than the normal magnitude and greater than the magnitude of the second DC supply voltage. The inefficient power supply continues to generate the second DC supply voltage in the low-power mode when the electrical load is off and the magnitude of the first DC supply voltage has decreased to the decreased magnitude.

According to another embodiment of the present invention, a multi-stage power supply for a load control device for controlling the amount of power delivered to an electrical load comprises: (1) a first efficient power supply operable to generate a first DC supply voltage having a normal magnitude in a normal mode of operation; (2) a second inefficient power supply operable to receive the first DC supply voltage and to generate a second DC supply voltage for powering the controller; and (3) a low-power mode adjustment circuit coupled to the efficient power supply for controlling the efficient power supply when the electrical load is off, such that the magnitude of the first DC supply voltage decreases to a decreased magnitude that is less than the normal magnitude and greater than the magnitude of the second DC supply voltage in the low-power mode, and the inefficient power supply continues to generate the second DC supply voltage in the low-power mode.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
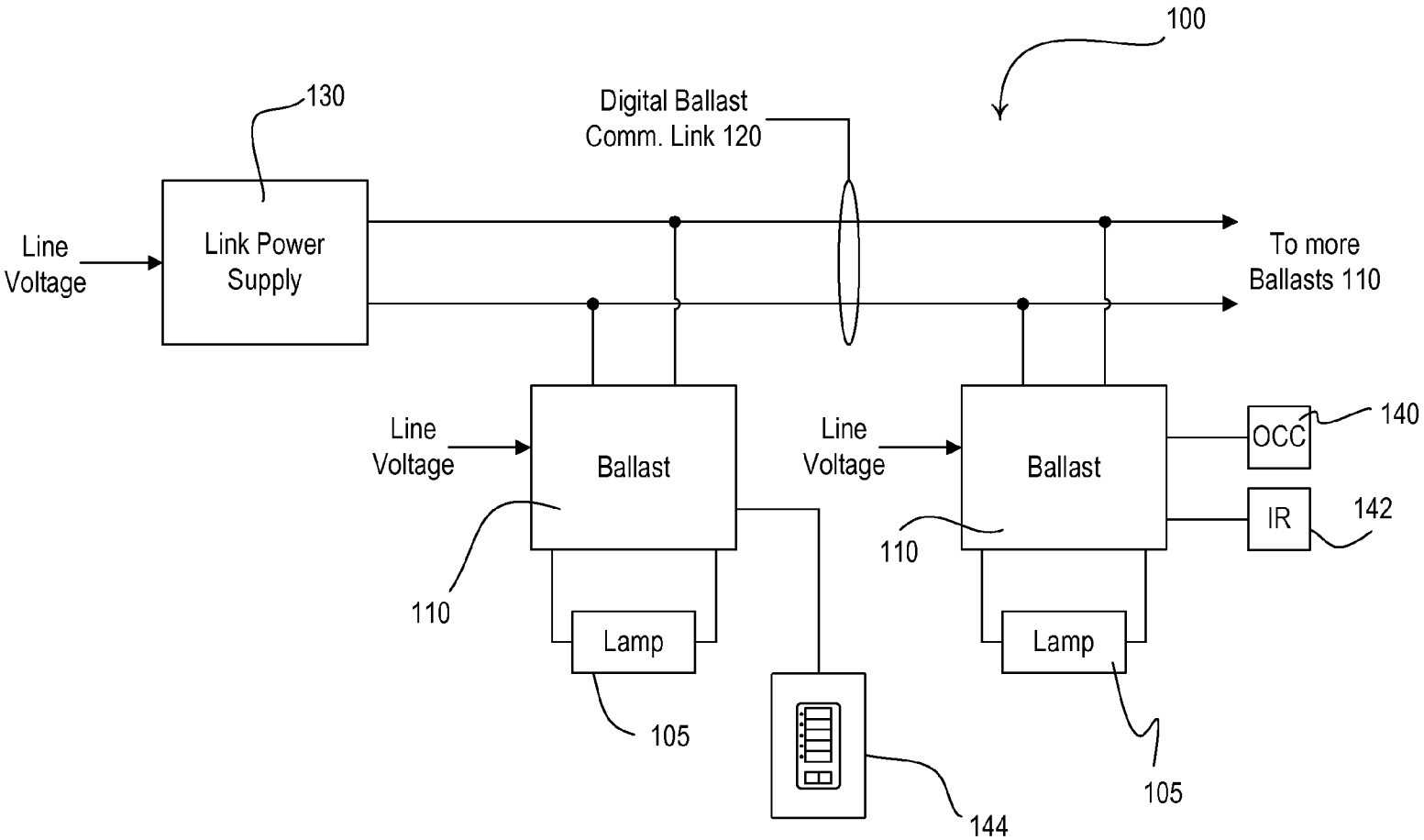
FIG. 1 is a simplified block diagram of a load control system having a plurality of ballasts for control of the intensity of a plurality of fluorescent lamps according to a first embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of a fluorescent lighting control system 100 for control of the intensity of a plurality of fluorescent lamps 105 according to a first embodiment of the present invention. The fluorescent lighting control system 100 includes two digital electronic dimming ballasts 110 coupled to a digital ballast communication link 120. The ballasts 110 are each coupled to an alternating-current (AC) mains line voltage and control the amount of power delivered to the lamp 105 to thus control the intensities of the lamps. The control system 100 further comprises a link power supply 130 coupled to the digital ballast communication link 120. The link power supply 130 receives the AC mains line voltage and generates a DC link voltage for the digital ballast communication link 120. The ballasts 110 are operable to communicate with each other by transmitting and receiving digital messages via the communication link using, for example, the digital addressable lighting interface (DALI) protocol. The digital ballast communication link 120 may be coupled to more ballasts 110, for example, up to 64 ballasts. Each ballast 110 may further receive a plurality of inputs from, for example, an occupancy sensor 140, an infrared (IR) receiver 142, and a keypad 144, and to subsequently control the intensities of the lamps 105 in response.

Figure 2:
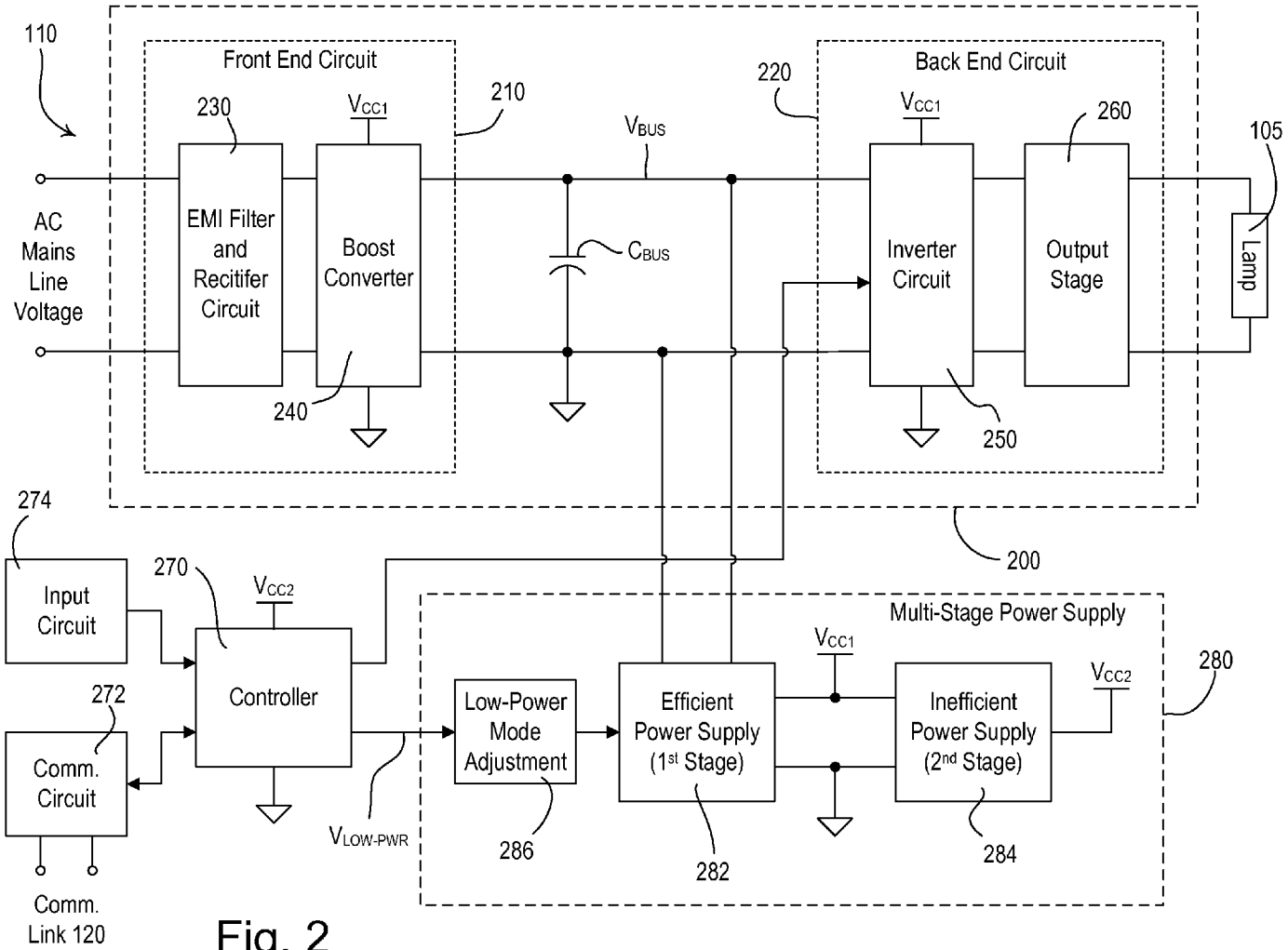
FIG. 2 is a simplified block diagram of one of the digital electronic dimming ballasts of the load control system of FIG. 1 according to the first embodiment of the present invention.

FIG. 2 is a simplified block diagram of one of the digital electronic dimming ballasts 110 according to the first embodiment of the present invention. The electronic ballast 110 includes a load control circuit 200 coupled between the AC mains line voltage and the lamp 105 for control of the intensity of the lamp. The load control circuit 200 comprises a front end circuit 210 and a back end circuit 220. The front end circuit 210 includes an EMI (electromagnetic interference) filter and rectifier circuit 230 for minimizing the noise provided on the AC mains and for generating a rectified voltage from the AC mains line voltage. The front end circuit 210 further comprises a boost converter 240 for generating a direct-current (DC) bus voltage $V_{BUS}$ across a bus capacitor $C_{BUS}$. The DC bus voltage $V_{BUS}$ typically has a magnitude (e.g., 465 V) that is greater than the peak voltage $V_{PK}$ of the AC mains line voltage (e.g., 170 V). The boost converter 240 also operates as a power-factor correction (PFC) circuit for improving the power factor of the ballast 110. For example, the front end circuit 210 may comprise a semiconductor switch (not shown), a transformer (not shown), and a PFC integrated circuit (not shown), such as, part number TDA4863 manufactured by Infineon Technologies AG. The PFC integrated circuit renders the semiconductor switch to conductive and non-conductive to selectively conduct current through the transformer to thus generate the bus voltage $V_{BUS}$.

The back end circuit 220 includes an inverter circuit 250 for converting the DC bus voltage $V_{BUS}$ to a high-frequency AC voltage. The inverter circuit 250 comprises one or more semiconductor switches, for example, two FETs (not shown), and a ballast control integrated circuit (not shown) for controlling the FETs. The ballast control integrated circuit is operable to selectively render the FETs conductive to control the intensity of the lamp 105. The ballast control integrated circuit may comprise, for example, part number NCP5111 manufactured by On Semiconductor. The back end circuit 220 further comprises an output circuit 260 comprising a resonant tank circuit for coupling the high-frequency AC voltage generated by the inverter circuit 250 to the filaments of the lamp 105.

A controller 270 is coupled to the inverter circuit 250 for control of the switching of the FETs to thus turn the lamp 105 on and off and to control (i.e., dim) the intensity of the lamp 105 between a minimum intensity (e.g., 1%) and a maximum intensity (e.g., 100%). The controller 270 may comprise, for example, a microcontroller, a programmable logic device (PLD), a microprocessor, an application specific integrated circuit (ASIC), or any suitable type of controller or control circuit. A communication circuit 272 is coupled to the controller 270 and allows the ballast 110 to communication (i.e., transmit and receive digital messages) with the other ballasts on the digital ballast communication link 120. The ballast 110 may further comprise an input circuit 274 coupled to the controller 270, such that the controller may be responsive to the inputs received from the occupancy sensor 140, the IR receiver 142, and the keypad 144. Examples of ballasts are described in greater detail in commonly-assigned U.S. patent Ser. No. 11/352,962, filed Feb. 13, 2006, entitled ELECTRONIC BALLAST HAVING ADAPTIVE FREQUENCY SHIFTING; U.S. patent Ser. No. 11/801,860, filed May 11, 2007, entitled ELECTRONIC BALLAST HAVING A BOOST CONVERTER WITH AN IMPROVED RANGE OF OUTPUT POWER; and U.S. patent application Ser. No. 11/787,934, filed Apr. 18, 2007, entitled COMMUNICATION CIRCUIT FOR A DIGITAL ELECTRONIC DIMMING BALLAST, the entire disclosures of which are hereby incorporated by reference.

The ballast 110 further comprises a multi-stage power supply 280 having a low-power mode when the lamp 105 is off. The power supply 280 comprises two stages: a first efficient power supply (e.g., a switching power supply 282) and a second inefficient power supply (e.g., a linear power supply 284). The switching power supply 282 receives the DC bus voltage $V_{BUS}$ and generates a first DC supply voltage $V_{CC1}$ (e.g., having a normal magnitude $V_{NORM}$ of approximately 15 V). Alternatively, the switching power supply 282 could receive the rectified voltage generated by the EMI filter and rectifier circuit 230 of the front end circuit 210. The PFC integrated circuit of the boost converter 240 and the ballast control integrated circuit of the inverter circuit 250 are powered by the first DC supply voltage $V_{CC1}$. The linear power supply 284 receives the first DC supply voltage $V_{CC1}$ and generates a second DC supply voltage $V_{CC2}$ (e.g., approximately 5 V) for powering the controller 270. Both the first and second supply voltages $V_{CC1}$, $V_{CC2}$ are referenced to a circuit common of the ballast 110. Alternatively, the switching power supply 282 could be coupled directed to the AC mains line voltage or to the output of the EMI filter and rectifier circuit 230.

When the lamp 105 is on (i.e., the intensity of the lamp range from the minimum intensity of 1% to the maximum intensity 100%), the power supply 280 operates in a normal mode of operation. Specifically, the switching power supply 282 converts the DC bus voltage $V_{BUS}$ (i.e., approximately 465 volts) to the first DC supply voltage $V_{CC1}$ (i.e., the normal magnitude $V_{NORM}$ of approximately 15 volts), such that there is a voltage drop of approximately 450 volts across the switching power supply 282. Further, the linear power supply 284 reduces the first DC supply voltage $V_{CC1}$ to the second DC supply voltage $V_{CC2}$, such that there is a voltage drop of approximately 10 volts across the linear power supply. Accordingly, there may be a power loss of, for example, approximately 20 mW in the switching power supply 282 and approximately 360 mW in the linear power supply 284, such that the total power loss of the two-stage power supply is approximately 380 mW in the normal mode of operation.

The power supply 280 further comprises a low-power mode adjustment circuit 286, which receives a low-power mode control signal $V_{LOW\text{-}PWR}$ from the controller 270. The low-power mode adjustment circuit 286 is coupled to the switching power supply 282, such that the controller 270 is operable to control the operation of the power supply 280. When the lamp 105 is off (i.e., at 0%), the controller 270 drives the low-power mode control signal $V_{LOW\text{-}PWR}$ high (e.g., to approximately the second DC supply voltage $V_{CC2}$), such that the power supply 280 operates in a low-power mode. At this time, the magnitude of the first DC supply voltage $V_{CC1}$ generated by the switching power supply 282 decreases to a decreased magnitude $V_{DEC}$, which is less than the normal magnitude $V_{NORM}$ and greater than the magnitude of the second DC supply voltage $V_{CC2}$. For example, the decreased magnitude $V_{DEC}$ may be approximately 8 volts. The linear power supply 284 continues to generate the second DC supply voltage $V_{CC2}$ when the power supply 280 is operating in the low-power mode. Therefore, the controller 270 is still powered and is operable to receive inputs from the input circuit 274 and to transmit and receive digital messages via the communication circuit 272 when the lamp 105 is off and the power supply 280 is operating in the low-power mode.

In the low-power mode, the voltage drop across the linear power supply 284 decreases to approximately 3 volts. The average power loss of the linear power supply 284 is equal to approximately the voltage drop across the linear power supply multiplied by the average current drawn by the controller 270 and other low-voltage circuitry powered by the second DC supply voltage $V_{CC2}$. Thus, when the voltage drop across the linear power supply 284 decreases in the low-power mode, the power loss of the linear power supply also decreases.

The decreased magnitude $V_{DEC}$ is less than the rated supply voltages of the PFC integrated circuit of the boost converter 240 and the ballast control integrated circuit of the inverter circuit 250. Therefore, when the magnitude of the first DC supply voltage $V_{CC1}$ decreases from the normal magnitude $V_{NORM}$ to the decreased magnitude $V_{DEC}$ in the low-power mode, the PFC integrated circuit of the boost converter 240 and the ballast control integrated circuit of the inverter circuit 250 stop operating. For example, the ballast control integrated circuit may comprise an under-voltage lockout (UVLO) feature that ensures that the ballast control integrated circuit does not render the controlled semiconductor switches conductive when the first DC supply voltage $V_{CC1}$ decreases to the decreased magnitude $V_{DEC}$ in the low-power mode. Since the boost converter 240 and the inverter circuit 250 do not operate in the low-power mode, there is minimal power dissipation in the transformer and the semiconductor switches of the boost converter and the inverter circuit, and the current drawn from the first DC supply voltage $V_{CC1}$ decreases, such that the ballast 110 consumes less power. In addition, the magnitude of the bus voltage $V_{BUS}$ decreases to approximately the peak voltage $V_{PK}$ of the AC mains line voltage (i.e., approximately 170 V) because the boost converter 240 does not operate in the low-power mode. Thus, the voltage drop across the switching power supply 282 decreases to approximately 162V volts in the low-power mode. As a result, there may be a power loss of, for example, approximately 7 mW in the switching power supply 282 and approximately 120 mW in the linear power supply 284 in the low-power mode, such that the total power loss in the two-stage power supply 280 is approximately 127 mW. Accordingly, the two-stage power supply 280 operates more efficiently in the low-power mode than in the normal mode.

Figure 3:
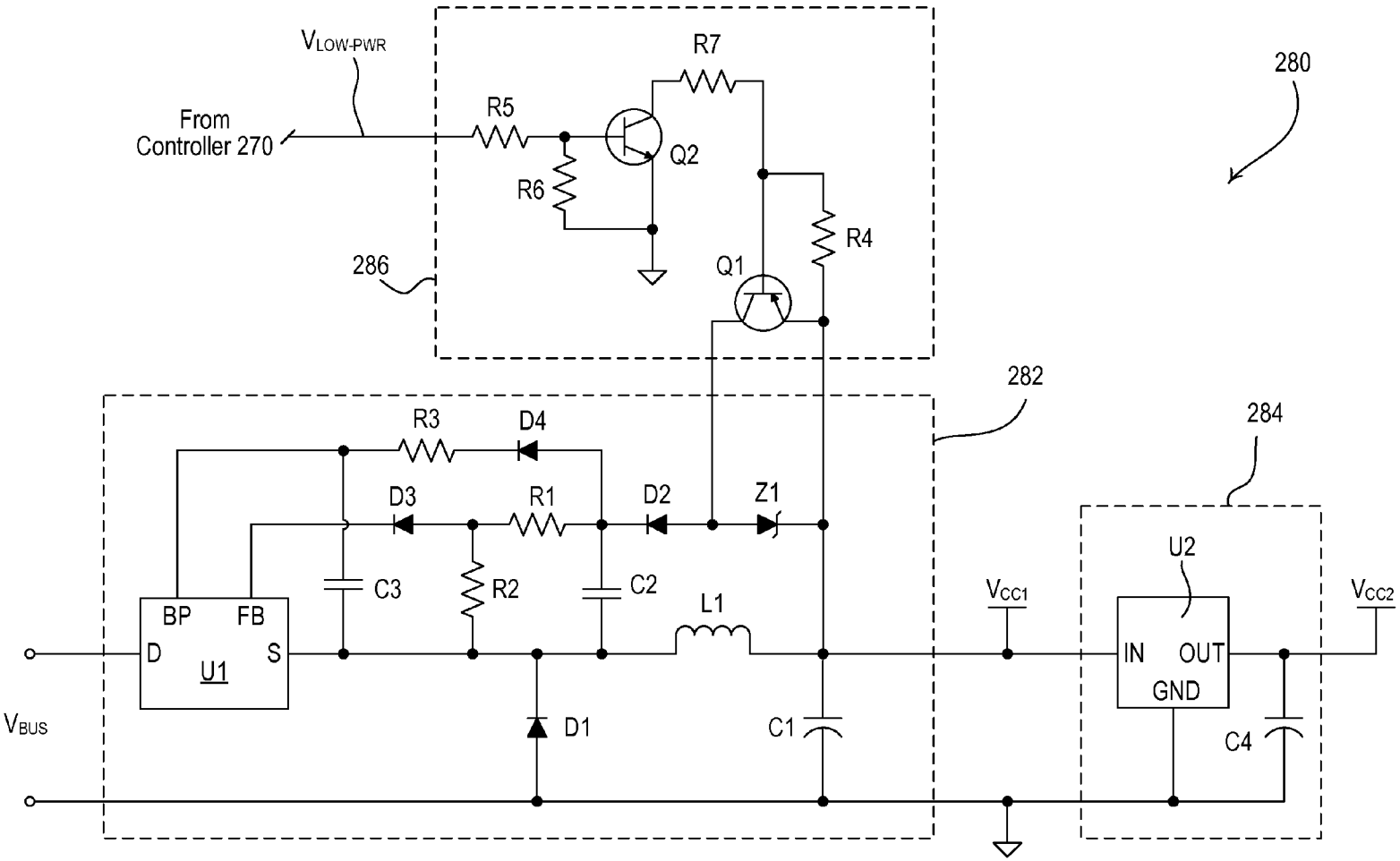
FIG. 3 is a two-stage power supply of the digital electronic dimming ballast of FIG. 2.

FIG. 3 is a simplified schematic diagram of the two-stage power supply 280. As previously mentioned, the switching power supply 282 receives the bus voltage $V_{BUS}$ that is generated by the boost converter 240. The switching power supply 282 comprises a control integrated circuit (IC) U1, which includes a semiconductor switch, such as a field-effect transistor (FET), coupled between a drain terminal D and a source terminal S. The control IC U1 may comprise, for example, part number LNK304 manufactured by Power Integrations. The first DC supply voltage $V_{CC1}$ is generated across an energy storage capacitor C1 (e.g., having a capacitance of approximately 22 μf). An inductor L1 is coupled between the capacitor C1 and the source terminal of the control IC U1 and has, for example, an inductance of approximately 1500 μH. A diode D1 is coupled between the circuit common and the source terminal of the control IC U1. As shown in FIG. 3, the FET of the control IC U1, the inductor L1, the capacitor C1, and the diode D1 form a standard buck converter. Alternatively, a different switching power supply topology could be used to generate the first DC supply voltage $V_{CC1}$ from the bus voltage $V_{BUS}$.

The switching power supply 282 further comprises a feedback circuit comprising two diodes D2, D3, a zener diode Z1, a capacitor C2, and two resistors R1, R2. The feedback circuit is coupled between the DC supply voltage $V_{CC1}$ and a feedback terminal FB of the control IC U1. The control IC U1 renders the FET conductive and non-conductive to selectively charge the capacitor C1, such that a feedback voltage at the feedback terminal FB is maintained at a specific magnitude, e.g., approximately 1.65 volts. For example, the zener diode Z1 has a break-over voltage $V_{BO}$ of approximately 6.2V, the resistor R1 has a resistance of approximately 5.11 kΩ, and the resistor R2 has a resistance approximately 2.00 kΩ, such that the DC supply voltage $V_{CC1}$ generated by the switching power supply 282 has the normal magnitude $V_{NORM}$ of approximately 15 volts in the normal mode of operation. The capacitor C2 has, for example, a capacitance of approximately 1.0 μF.

The switching power supply 282 also comprises a bypass capacitor C3 for use by an internal power supply of the control IC U1. The bypass capacitor C3 is coupled between a bypass terminal BP and the source terminal S of the control IC U1, and has, for example, a capacitance of approximately 0.1 μF. The bypass capacitor C3 is operable to charge from the control IC U1 through the bypass terminal BP. However, to allow for more efficient operation, the bypass capacitor C3 is also operable to charge from the DC bus voltage $V_{CC1}$ through the zener diode Z1, the diode D3, a resistor R3 (e.g., having a resistance of approximately 2.32 kΩ), and another diode D4.

The linear power supply 284 receives the first DC supply voltage $V_{CC1}$ and generates the second DC supply voltage $V_{CC2}$. The linear power supply 284 comprises a linear regulator U2, which operates to produce the second DC supply voltage $V_{CC2}$ across a capacitor C4 (e.g., having a capacitance of approximately 10 μF). The linear regulator U2 may comprise, for example, part number MC78L05A manufactured by On Semiconductor. The decreased magnitude $V_{DEC}$ (i.e., approximately 8 V) is greater than a rated dropout voltage of the linear regulator U2 (e.g., approximately 6.7 V) below which the linear regulator U2 will stop generating the second DC supply voltage $V_{CC2}$. Therefore, the linear power supply 284 continues to generate the second DC supply voltage $V_{CC2}$ when the power supply 280 is operating in the low-power mode.

The low-power mode adjustment circuit 286 is coupled to the switching power supply 282 and receives the low-power mode control signal $V_{LOW\text{-}PWR}$ from the controller 270. The controller 270 drives the low-power mode control signal $V_{LOW\text{-}PWR}$ low (i.e., to approximately circuit common) to operate the power supply 280 in the normal mode when the lamp 105 is on and drives the low-power mode control signal $V_{LOW\text{-}PWR}$ high (i.e., to approximately the second DC supply voltage $V_{CC2}$) to operate the power supply in the low-power mode when the lamp is off. The low-power mode adjustment circuit 286 comprises a PNP bipolar junction transistor (BJT) Q1 coupled across the zener diode Z1 of the switching power supply 282. A resistor R4 is coupled between the emitter and the base of the transistor Q1 and has a resistance of, for example, approximately 10 kΩ. The low-power mode control signal $V_{LOW\text{-}PWR}$ is coupled to the base of an NPN bipolar junction transistor Q2 through a resistor R5 (e.g., having a resistance of approximately 4.99 kΩ). A resistor R6 is coupled between the base and the emitter of the transistor Q2 and has a resistance of approximately 10 kΩ.

When the low-power mode control signal $V_{LOW\text{-}PWR}$ is low, both of the transistors Q1, Q2 are non-conductive, and thus, the switching power supply 282 operates to generate the first DC supply voltage $V_{CC1}$ at the normal magnitude $V_{NORM}$ of approximately 15 V as described above. However, when the low-power mode control signal $V_{LOW\text{-}PWR}$ is driven high by the controller 270, the transistor Q2 is rendered conductive and the base of the transistor Q1 is pulled down towards circuit common through a resistor R7 (e.g., having a resistance of approximately 6.81 kΩ). Accordingly, the transistor Q1 is rendered conductive, thus, "shorting out" the zener diode Z1 of the switching power supply 282. Since the zener diode Z1 is essentially removed from the feedback circuit of the switching power supply 282, the control IC U1 now operates to maintain the magnitude of the first DC supply voltage $V_{CC1}$ at the decreased magnitude $V_{DEC}$. In other words, the magnitude of the first DC supply voltage $V_{CC1}$ is no longer dependent upon the breakover voltage $V_{BO}$ of the zener diode Z1. The decreased magnitude $V_{DEC}$ is approximately equal to the difference between the normal magnitude $V_{NORM}$ of the first DC supply voltage $V_{CC1}$ and the breakover voltage $V_{BO}$ of the zener diode Z1.

Figure 4:
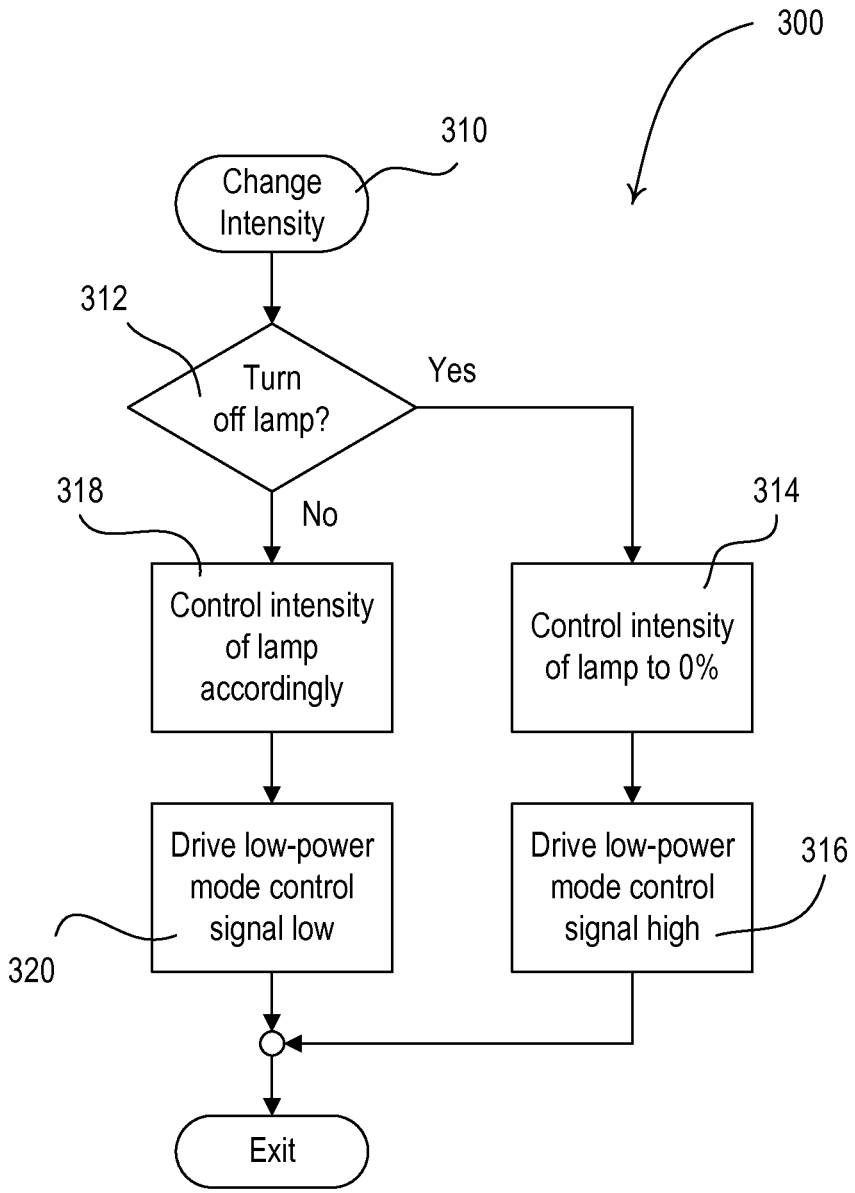
FIG. 4 is a simplified flowchart of a control procedure executed by a controller of the digital electronic dimming ballast of FIG. 2.

FIG. 4 is a simplified flowchart of a control procedure 300 executed by the controller 270 of the ballast 110 in response to receiving a command to change the intensity of the lamp 105 at step 310, e.g., in response to digital messages received via the communication circuit 272 or in response to inputs received from the occupancy sensor 140, the IR receiver 142, and the keypad 144 via the input circuit 274. If the received command is to turn the lamp 105 off at step 312, the controller 270 controls the inverter circuit 250 to control the intensity of the lamp to 0% at step 314 and drives the low-power mode control signal $V_{LOW\text{-}PWR}$ high to operate the power supply 280 in the low-power mode at step 316, before the control procedure 300 exits. If the received command is not to turn the lamp 105 off at step 312, the controller 270 adjusts intensity of the lamp according to the received command (e.g., to a specific intensity) at step 318 and drives the low-power mode control signal $V_{LOW\text{-}PWR}$ low to operate the power supply 280 in the normal mode at step 320, before the control procedure 300 exits.

Figure 5:
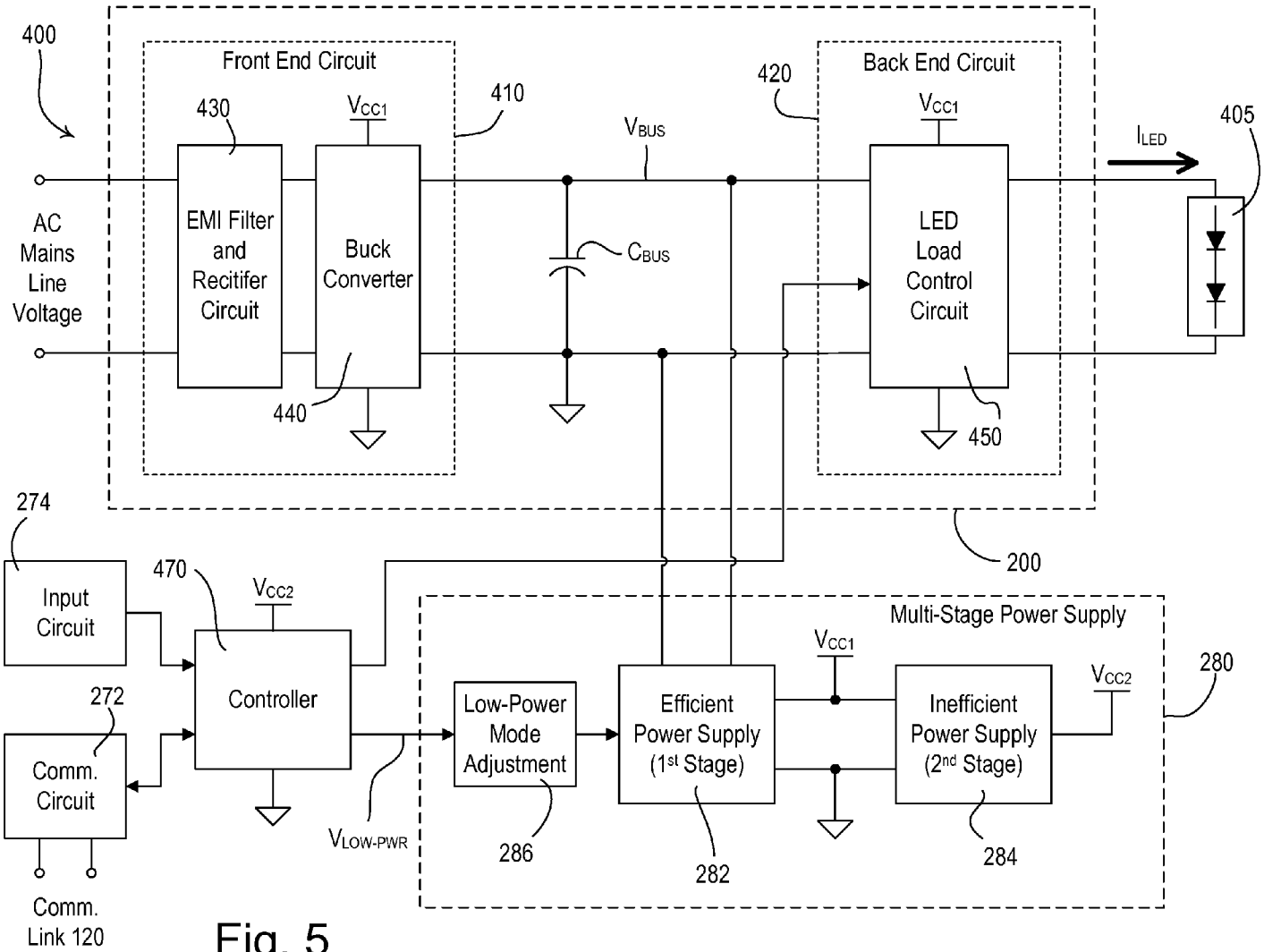
FIG. 5 is a simplified block diagram of a light-emitting diode (LED) driver for controlling the intensity of a LED light source according to a second embodiment of the present invention.

FIG. 5 is a simplified block diagram of an LED driver 400 for controlling the intensity of an LED light source 405 according to a second embodiment of the present invention. The LED driver 400 comprises a front end circuit 410 including an EMI filter and rectifier circuit 430 and a buck converter 440 for generating a direct-current (DC) bus voltage $V_{BUS}$ that has a magnitude less than the peak voltage $V_{PK}$ of the AC mains line voltage (e.g., approximately 60 V). Alternatively, the buck converter 440 could be replaced by a boost converter, a buck/boost converter, or a flyback converter. The LED driver 400 also includes a back end circuit 420, which comprises an LED load control circuit 450, and a controller 470 for controlling the operation of the LED load control circuit 450. As in the first embodiment, the multi-stage power supply 280 comprises the switching power supply 282, the linear power supply 284, and the low-power mode adjustment circuit 286. The controller 470 is operable to control the multi-stage power supply 280 to the low-power mode when the LED light source 405 is off (as in the first embodiment of the present invention).

The LED load control circuit 450 receives the bus voltage $V_{BUS}$ and regulates the magnitude of an LED output current $I_{LED}$ conducted through the LED light source 405 (by controlling the frequency and the duty cycle of the LED output current $I_{LED}$) in response to the controller 470 to thus control the intensity of the LED light source. For example, the LED load control circuit 450 may comprise a LED driver integrated circuit (not shown), for example, part number MAX16831, manufactured by Maxim Integrated Products. To control the intensity of the LED light source 405, the LED load control circuit 450 may be operable to adjust the magnitude of the LED output current $I_{LED}$ or to pulse-width modulate (PWM) the LED output current. An example of an LED driver is described in greater detail in co-pending, commonly-assigned U.S. Provisional Patent Application No. 61/249,477, filed Oct. 7, 2009, entitled LOAD CONTROL DEVICE FOR A LIGHT-EMITTING DIODE LIGHT SOURCE, the entire disclosure of which is hereby incorporated by reference.

Figure 6:
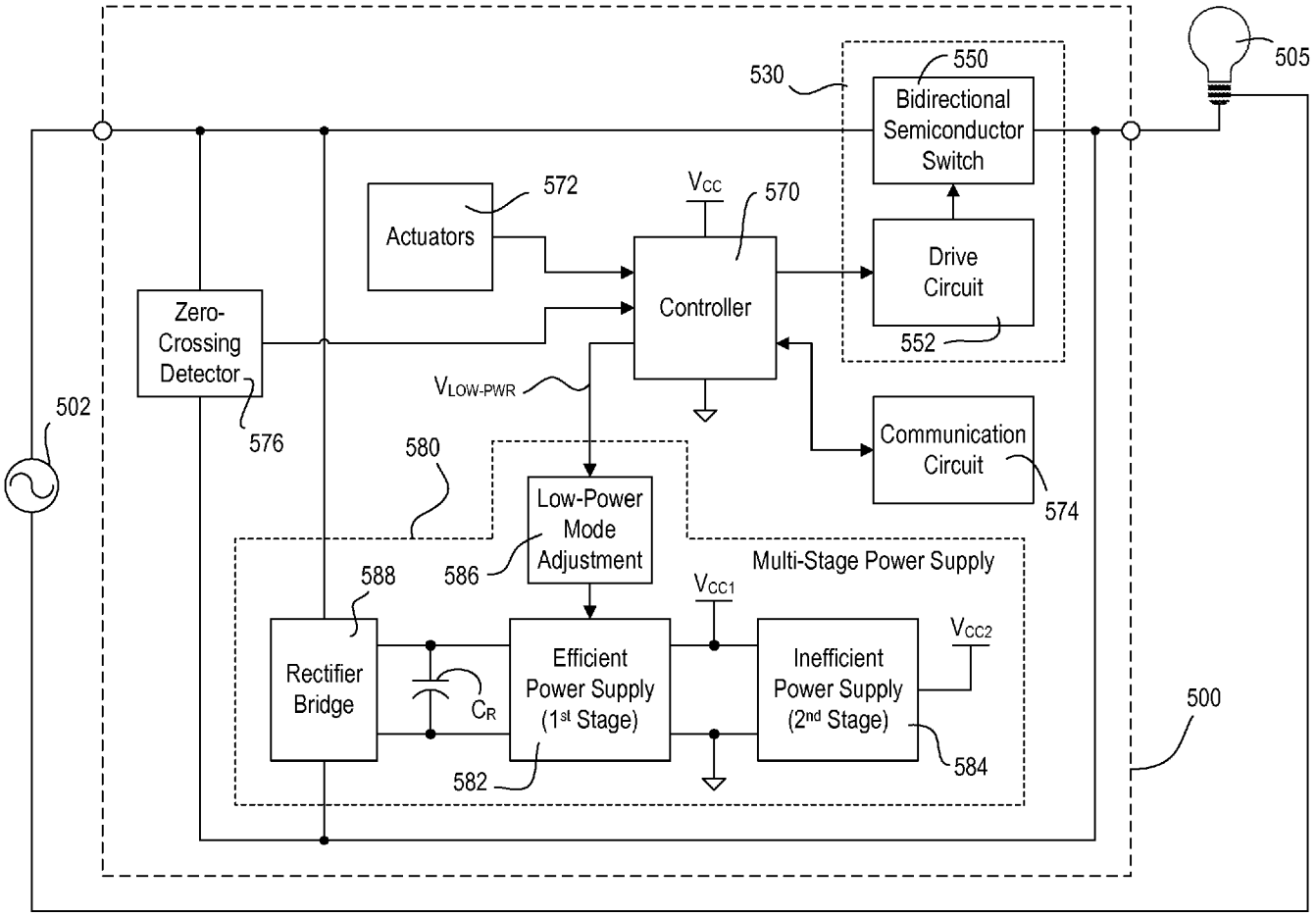
FIG. 6 is a simplified block diagram of a dimmer switch for controlling the amount of power delivered to a lighting load according to a third embodiment of the present invention.

FIG. 6 is a simplified block diagram of a dimmer switch 500 for controlling the amount of power delivered from an AC power source 502 to a lighting load 505, such as an incandescent lamp, according to a third embodiment of the present invention. The dimmer switch 500 comprises a load control circuit 530 (e.g., a dimmer circuit) coupled in series electrical connection between the AC power source 502 and the lighting load 505, and a controller 570 for controlling the operation of the load control circuit and thus the intensity of the lighting load.

The dimmer switch 500 may be adapted to be mounted to a standard electrical wallbox (i.e., replacing a standard light switch), and may comprise one or more actuators 572 for receiving user inputs. The controller 570 is operable to toggle (i.e., turn on and off) the lighting load 505 and to adjust the amount of power being delivered to the lighting load in response to the inputs received from the actuators 572.

The controller 570 may be further coupled to a communication circuit 574 for transmitting and receiving digital messages via a communication link, such as a wired communication link or a wireless communication link, e.g., a radio-frequency (RF) communication link or an infrared (IR) communication link. The controller 570 may be operable to control the controllably conductive device 574 in response to the digital messages received via the communication circuit 574. Examples of RF load control systems are described in greater detail in U.S. patent application Ser. No. 11/713,854, filed Mar. 5, 2007, entitled METHOD OF PROGRAMMING A LIGHTING PRESET FROM A RADIO-FREQUENCY REMOTE CONTROL, and U.S. patent application Ser. No. 12/033,223, filed Feb. 19, 2008, entitled COMMUNICATION PROTOCOL FOR A RADIO-FREQUENCY LOAD CONTROL SYSTEM. An example of an IR load control system is described in greater detail in U.S. Pat. No. 6,545,434, issued Apr. 8, 2003, entitled MULTI-SCENE PRESET LIGHTING CONTROLLER. The entire disclosures of these three patents are hereby incorporated by reference.

The load control circuit 530 includes a controllably conductive device (e.g., a bidirectional semiconductor switch 550) adapted to conduct a load current through the lighting load 505, and a drive circuit 552 coupled to a control input (e.g., a gate) of the bidirectional semiconductor switch for rendering the bidirectional semiconductor switch conductive and non-conductive in response to control signals generated by the controller 570. The bidirectional semiconductor switch 550 may comprise any suitable type of controllable switching device, such as, for example, a triac, a field-effect transistor (FET) in a rectifier bridge, two FETs in anti-series connection, or two or more insulated-gate bipolar junction transistors (IGBTs). A zero-crossing detector 576 is coupled across the bidirectional semiconductor switch 550 and determines the zero-crossings of the AC mains line voltage of the AC power supply 502, i.e., the times at which the AC mains line voltage transitions from positive to negative polarity, or from negative to positive polarity, at the beginning of each half-cycle. Using a standard phase-control technique, the controller 576 selectively renders the bidirectional semiconductor switch 550 conductive at predetermined times relative to the zero-crossing points of the AC mains line voltage, such that the bidirectional semiconductor switch is conductive for a portion of each half-cycle of the AC mains line voltage. Typical dimmer circuits are described in greater detail in U.S. Pat. No. 5,248,919, issued Sep. 29, 1993, entitled LIGHTING CONTROL DEVICE, and U.S. Pat. No. 7,242,150, issued Jul. 10, 2007, entitled DIMMER HAVING A POWER SUPPLY MONITORING CIRCUIT. The entire disclosures of both patents are hereby incorporated by reference.

The dimmer switch 500 comprises a multi-stage power supply 580 that operates in a low-power mode when the lighting load 505 is off (as in the first and second embodiments of the present invention). The power supply 580 comprises a first efficient power supply (e.g., a switching power supply 582) and a second inefficient power supply (e.g., a linear power supply 584). The power supply 580 also comprises a rectifier bridge 588 and a capacitor CR for generating a rectified voltage, which is provided to the switching power supply 582. As in the first and second embodiments, a low-power mode adjustment circuit 586 controls the power supply into the low-power mode in response to a low-power mode control signal $V_{LOW\text{-}PWR}$ received from the controller 570. Specifically, the controller 570 controls the power supply 580 to the low-power mode when the lighting load 505 is off.

While the present invention has been described with reference to the ballast 110, the LED driver 400, and the dimmer switch 500, the multi-stage power supply 280, 480 of the present invention could be used in any type of control device of a load control system, such as, for example, a remote control, a keypad device, a visual display device, an electronic switch, a switching circuit including a relay, a controllable plug-in module adapted to be plugged into an electrical receptacle, a controllable screw-in module adapted to be screwed into the electrical socket (e.g., an Edison socket) of a lamp, a motor speed control device, a motorized window treatment, a temperature control device, an audio/visual control device, or a dimmer circuit for other types of lighting loads, such as, magnetic low-voltage lighting loads, electronic low-voltage lighting loads, and screw-in compact fluorescent lamps.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A load control device for controlling the amount of power delivered from a power source to an electrical load, the load control device comprising:

a load control circuit adapted to be coupled between the source and the load for controlling the power delivered to the load;

a controller operatively coupled to the load control circuit and operable to control the load control circuit to turn the electrical load off; and a multi-stage power supply comprising a first efficient power supply operable to generate a first DC supply voltage output and a second inefficient power supply operable to receive the first DC supply voltage output and to generate a second DC supply voltage output for powering the controller, the first DC supply voltage output having a normal magnitude in a normal mode of operation;

wherein the controller is coupled to the multi-stage power supply for controlling the multi-stage power supply to a low-power mode when the electrical load is off, such that the magnitude of the first DC supply voltage output decreases to a decreased magnitude that is less than the normal magnitude and greater than the magnitude of the second DC supply voltage output, and the second inefficient power supply continues to generate the second DC supply voltage output in the low-power mode when the electrical load is off and the magnitude of the first DC supply voltage output has decreased to the decreased magnitude.

2. The load control device of claim 1, wherein the efficient power supply comprises a switching power supply and the inefficient power supply comprises a linear regulator.

3. The load control device of claim 2, wherein the electrical load comprises a gas discharge lamp, and the load control device comprises an electronic dimming ballast operable to control the amount of power delivered to the lamp to thus control the intensity of the lamp.

4. The load control device of claim 3, wherein the load control circuit comprises a front end circuit for generating a DC bus voltage across a bus capacitor, and a back end circuit for generating a high-frequency AC voltage for driving the lamp.

5. The load control device of claim 4, wherein the back end circuit comprises an inverter circuit having at least one semiconductor switch and a ballast control integrated circuit for driving the semiconductor switch, the ballast control integrated circuit powered by the first DC supply voltage output, the ballast control integrated circuit being unpowered in the low-power mode, such that the inverter circuit does not operate in the low-power mode.

6. The load control device of claim 5, wherein the front end circuit comprises a PFC circuit having at least one semiconductor switch and a PFC integrated circuit for driving the semiconductor switch, the PFC integrated circuit powered by the first DC supply voltage output, the PFC integrated circuit being unpowered in the low-power mode, such that the PFC circuit does not operate in the low-power mode.

7. The load control device of claim 4, wherein the switching power supply is operable to receive the bus voltage.

8. The load control device of claim 4, wherein the front end circuit comprises a rectifier circuit for generating a rectified voltage, the switching power supply operable to receive the rectified voltage.

9. The load control device of claim 2, wherein the electrical load comprises a light-emitting diode (LED) light source and the load control device comprises an LED driver operable to regulate the magnitude of a load current flowing through the LED light source to thus control the intensity of the LED light source.

10. The load control device of claim 9, wherein the load control circuit is operable to adjust the magnitude of the load current flowing through the LED light source.

11. The load control device of claim 9, wherein the load control circuit is operable to pulse-width modulate a load current flowing through the LED light source.

12. The load control device of claim 2, wherein the electrical load comprises a lighting load and the load control device comprises a dimmer switch.

13. The load control device of claim 12, wherein the load control circuit comprises a bidirectional semiconductor switch adapted to be coupled in series electrical connection between the source and the lighting load for controlling the amount of power being delivered to the load.

14. The load control device of claim 13, wherein the controller is operable to render the bidirectional semiconductor switch conductive for a portion of each half-cycle of the AC power source using a phase-control technique, so as to control the amount of power being delivered to the lighting load and thus the intensity of the lighting load.

15. The load control device of claim 2, wherein the multi-stage power supply comprises a low-power mode adjustment circuit coupled to the controller and the switching power supply, such that the controller is operable to adjust the multi-stage power supply between the normal mode and the low-power mode.

16. The load control device of claim 15, wherein the switching power supply comprises a buck converter and a feedback circuit having a zener diode, such that the normal magnitude of the first DC supply voltage output is dependent upon a breakover voltage of the zener diode.

17. The load control device of claim 16, wherein the low-power mode adjustment circuit comprises a transistor coupled across the zener diode of the switching power supply, the transistor rendered conductive in the low-power mode, such that the magnitude of the first DC supply voltage output is no longer dependent upon the breakover voltage of the zener diode.

18. The load control device of claim 2, wherein a voltage drop across the linear regulator in the low-power mode is less than a voltage drop across the linear regulator in the normal mode.

19. The load control device of claim 2, further comprising:

at least one integrated circuit powered by the first DC supply voltage output;

wherein the integrated circuit is unpowered in the low-power mode.

20. A multi-stage power supply, the power supply supplying power to a load control device, the power supply having a normal mode of operation and a low-power mode of operation, the load control device controlling the amount of power delivered from a power source to an electrical load, the load control device having an integrated circuit and a controller, the power supply comprising:

a first efficient power supply operable to generate a first DC supply voltage output, the first DC supply voltage output operable to power the integrated circuit of the load control device, the first DC supply voltage output having a normal magnitude in the normal mode of operation;

a second inefficient power supply operable to receive the first DC supply voltage output and to generate a second DC supply voltage output, the second DC supply voltage output operable to power the controller of the load control device; and a low-power mode adjustment circuit coupled to the first efficient power supply, the low-power mode adjustment circuit controlling the first efficient power supply in the low-power mode of operation, such that the magnitude of the first DC supply voltage output decreases to a decreased magnitude that is less than the normal magnitude and greater than the magnitude of the second DC supply voltage output, and the second inefficient power supply generates the second DC supply voltage output.

21. The power supply of claim 20, wherein the efficient power supply comprises a switching power supply and the inefficient power supply comprises a linear regulator.

22. The power supply of claim 21, wherein the switching power supply comprises a buck converter and a feedback circuit having a zener diode, such that the normal magnitude of the first DC supply voltage output is dependent upon a breakover voltage of the zener diode.

23. The power supply of claim 22, wherein the low-power mode adjustment circuit comprises a transistor coupled across the zener diode of the switching power supply, the transistor rendered conductive in the low-power mode, such that the magnitude of the first DC supply voltage output is independent from the breakover voltage of the zener diode.

* * * * *